US006143967A

United States Patent [19]

Smith et al.

[11] Patent Number: 6,143,967

[45] Date of Patent: Nov. 7, 2000

[54] TREMOLO FOR GUITAR

[76] Inventors: Alexander M. Smith, 203 Roller Ave.; Thomas Brzezinski, 207 York St., both of Beaver Dam, Wis. 53916

[21] Appl. No.: 09/280,017

[22] Filed: Mar. 29, 1999

[51] Int. Cl.[7] ..... G10D 3/00

[52] U.S. Cl. ..... 84/313; 84/290

[58] Field of Search ..... 84/290, 298, 307, 84/313

[56] References Cited

U.S. PATENT DOCUMENTS

| | | | |
|---|---|---|---|
| 3,411,394 | 11/1968 | Jones . | |
| 4,171,661 | 10/1979 | Rose . | |
| 4,457,201 | 7/1984 | Storey . | |
| 4,632,005 | 12/1986 | Steinberger . | |
| 4,782,732 | 11/1988 | Kato et al. | 84/313 |
| 5,198,601 | 3/1993 | McCabe | 84/298 |
| 5,359,144 | 10/1994 | Benson | 84/313 |
| 5,419,227 | 5/1995 | Lavineway . | |
| 5,429,028 | 7/1995 | Fisher, IV | 84/313 |
| 5,435,219 | 7/1995 | Huff | 84/313 |
| 5,477,765 | 12/1995 | Dietzman | 84/313 |
| 5,520,082 | 5/1996 | Armstrong et al. | 84/313 |
| 5,522,297 | 6/1996 | Enserink . | |
| 5,747,713 | 5/1998 | Clement . | |
| 5,783,763 | 7/1998 | Schaller et al. . | |

*Primary Examiner*—Robert E. Nappi
*Assistant Examiner*—Kim Lockett
*Attorney, Agent, or Firm*—Donald Cayen

[57] ABSTRACT

A self-contained tremolo for a guitar or other stringed instrument provides exceptional ease of setup and operation. The tremolo has a base plate fastened to the guitar over a small cavity. A bridge is pivotally connected to the base plate by means of bridge pins that enter blind slots in the base plate. String tension is counteracted by a spring mechanism that includes studs received in the bridge and passing through holes in the base plate and entering the guitar cavity. Compression springs act between the studs and the base plate. Identical intonation blocks are held on steps in the bridge such that the contact points between the intonation blocks and the strings lie along a curved line that matches the curve of the guitar frets. Fine tuners have plugs with V-grooves that contact the strings. The plugs are held in threaded shanks, but they do not rotate with the shanks during fine tuner adjustment, thereby eliminating the tendency of the strings to twist or slip off the ends of the fine tuners. An arm employs friction to both enable rotation thereof within the bridge and to maintain a desired angular location.

37 Claims, 3 Drawing Sheets

8
13
14
7

11
9
13
7
1
8

8
8
102
5
16
15
3
30
2
2
81

100
33
45
49
35
32

63
24
53
71
51
68
41
75
70
65
4
81
43
4
27
69
73
32
17
49
35
47
39

30
20
95
51
17
96
39
23
13
41
33
15
37
24
29
26
31
21
27
5
100
98
49

TREMOLO FOR GUITAR

BACKGROUND OF THE INVENTION

1. Field of the Invention

This invention pertains to musical instruments, and more particularly to apparatus for adjusting the sound characteristics of string instruments.

2. Description of the Prior Art

Various equipment has been developed to change the tension of the strings in stringed musical instruments. For examples, tremolos, vibratos, or whammy bars for use in electric guitars are well known and in widespread use. The purpose of the tremolos is to change the tension in the guitar strings and thereby change their pitch and other tonal qualities.

Some prior tremolos include a base plate that is fastened to the guitar body. One or more bridges are pivotally connected either to the base plate or to the guitar body. One end of each instrument string is attached, either fixedly or adjustably, to the bridge. The second ends of the strings are attached to tuning pegs on the guitar head. The tension in the strings tends to pivot the bridge in a first direction so as to decrease the string tension. Springs acting on the bridge produce a force that equals or exceeds the string tension to maintain the desired string tension.

There typically are saddles on the bridge in contact with the strings. The saddles are adjustable to vary the string tonal qualities. In addition, there may be a fine tuning device that can vary the tension in each string.

Examples of prior tremolos may be seen in U.S. Pat. Nos. 3,411,394; 4,457,201; 4,632,005; 4,763,555; 4,984,493; 5,109,745; 5,127,298; 5,305,675; 5,373,769; 5,419,227; 5,431,079; 5,435,219; 5,438,902; 5,460,072; 5,477,765; 5,481,955; 5,515,761; 5,520,082; 5,522,297; 5,539,144; 5,551,329; 5,637,818; 5,672,835; 5,708,225; 5,747,713; 5,783,763; 5,808,216; 5,814,746; 5,824,925; 5,847,297; and 5,864,074.

The prior tremolos also include an arm on the bridge. The musician can press on the arm while he is playing the instrument to overcome the spring force and pivot the bridge to reduce the string tension, thereby changing the instrument's sound characteristics. Representative tremolo arms are shown in U.S. Pat. Nos. 5,522,298; 5,637,817; and 5,641,923.

Despite the large variety of prior tremolos presently available, they nevertheless are not completely satisfactory. An undesirable feature of many prior tremolos is that they occupy an excessive volume inside the guitar body. The relatively large amount of material that must be removed from the guitar body both weakens the instrument structurally, and also adversely affects its tonal qualities. That is especially true if material is removed from behind the electronic pickups on electric guitars. U.S. Pat. Nos. 4,984,493; 5,109,745; and 5,477,765 are examples of tremolos that require large cavities in the guitar body.

Another problem with many prior tremolos is that they make restringing and retuning a guitar difficult. That is because the tremolos contain a large number of small tuning-related parts. The tremolos of the U.S. Pat. Nos. 4,632,005; 5,419,227; and 5,477,765 for instance, have movable mounts to which the strings are attached. Obtaining the correct tension of a new string thus requires an interplay of adjustments between the string attachment points on the tremolo and on the tuning pegs on the guitar neck. A related drawback is that manufacturing, assembling, and adjusting the parts is expensive and time consuming. In some prior tremolos, if one string breaks all the remaining strings go out of tune.

Some prior tremolos, such as those shown in U.S. Pat. No. 5,419,227, utilize thumbscrews to adjust the string tension. However, the range of movement of the prior thumbscrews is limited because of the likelihood that the string will twist and slip off the thumbscrew.

A further problem with prior tremolos concerns the pivotal connection of the bridge to the base plate or to the guitar body. Some tremolos, such as those of the U.S. Pat. Nos. 4,632,005; 5,419,227; and 5,477,765 use pins and enclosed holes for the pivoting arrangement. That design renders both assembly and disassembly more difficult than is desired. Another pivot design incorporates a knife edge and post, as are typically shown in the U.S. Pat. Nos. 5,109,745; 5,431,079; and 5,438,902. Although the knife edge design eases the assembly problem compared with the prior pin and fixed hole design, the components required for the knife edge design are undesirably expensive to produce. In addition, the knife edges are prone to wear. A similar connection is shown in U.S. Pat. No. 4,763,555. U.S. Pat. No. 5,435,219 describes flexure plates pivotally connecting the base plate and bridge.

Yet another drawback of many prior tremolos is the design of the springs that counteract the string tensions. It is a desirable feature that the spring force be adjustable, and many prior tremolos incorporate adjustment mechanisms. However, the prior adjustment mechanisms are often complicated and cumbersome to use. U.S. Pat. Nos. 4,984,493, for example, utilizes three gears for the spring adjustment. The adjustment mechanism of the U.S. Pat. No. 5,431,079 requires an external tool for adjusting the spring. In many tremolos, the adjustment mechanism is connected to the guitar body, thus complicating assembly and disassembly.

Thus, a need exists for improvements to tremolos.

SUMMARY OF THE INVENTION

In accordance with the present invention, a compact self-contained tremolo provides excellent convenience and sound characteristics to a string instrument. This is accomplished by apparatus that includes a spring mechanism that occupies minimal space inside the instrument.

The tremolo is comprised of a base plate that is fastened to the instrument. The base plate supports a pair of lugs. The base plate defines at least one hole through it that is perpendicular to the plane of the instrument strings. The instrument has a small cavity that is aligned with the base plate hole. The tremolo is self-contained in that no portion of it other than the base plate is fastened to the instrument.

A bridge is pivotally connected to the base plate. It is a feature of the invention that the base plate lugs have slots in them that receive associated pins in the bridge. The pins and slots cooperate to enable the bridge to pivot relative to the base plate. The slot and pin arrangement further enables the bridge to be quickly and easily assembled to and disassembled from the base plate. At the same time, the slot and pin assure that the bridge remains pivotally connected to the base plate during setup, tuning, and playing.

First ends of the instrument strings are attached to and tightened by tuning pegs in the instrument. Second ends of the strings are anchored in a block on the bridge. Tension in the strings exerts a force on the bridge that tends to pivot it in a first direction relative to the base plate.

The bridge is urged to pivot in a second direction by the spring mechanism, which includes at least one compression spring. The spring is guided on a stud on the bridge that passes through the hole in the base plate. The spring is compressed between the base plate and a nut on the end of the stud. The stud and spring design is very compact and occupies only the small cavity in the instrument. The spring mechanism is sufficiently small such that no material need be removed from the instrument behind any electronic pickups. By turning the nut, the compression force in the spring can be varied. Normally the spring force is greater than the string tension such that the bridge tends to pivot in the second direction. Pivoting of the bridge in the second direction is limited by contact of the bridge with the base plate to place the bridge at an initial bridge position.

The bridge further comprises an intonation block in contact with each string. The intonation blocks are individually adjustable on the bridge along the strings to change the span between the string anchor points and the intonation blocks, and to simultaneously change the span between the guitar tuning pegs and the intonation blocks. It is an important feature of the invention that the spans of the strings between the string anchor points and the intonation blocks are relatively large. The contact points of the respective intonation blocks with the strings preferably lie along a curved line that matches the transverse curvature of the plane of the instrument strings. In keeping with the purpose of the invention, the intonation blocks are all identical. The curvature of the intonation block contact points with the associated strings is achieved by manufacturing the bridge with steps that produce the desired curvature of the contact points.

Fine tuners are threaded into the bridge block in operative association with the respective strings. By turning the fine tuners, the tensions in the strings are independently adjustable. Further in accordance with the present invention, the fine tuners are designed to maintain contact with the strings through all adjustments. For that purpose, each fine tuner is comprised of a small plug with a stem that is retained in and is rotatable relative to the shank of a thumbscrew. The plug has a V-notch. The thumbscrew shank is threaded into the bridge block such that the plug V-notch fits over the associated string. The thumbscrew is capable of considerable axial movement without twisting the string or having it slip off the end of the fine tuner.

To pivot the bridge in the first direction against the force of the spring mechanism, an arm is secured to the bridge. The bridge is designed to accept the arm in either of two locations that enable the tremolo to be used by both right handed and left handed musicians. The arm is retained by friction in the bridge. The arm can be rotated to any angular location relative to the instrument, and it will remain in that location by friction until it is again intentionally rotated to a different location.

To use the tremolo of the invention, a musician turns the knobs of the spring mechanism to set the desired tension in the springs. He anchors the second ends of the strings in the bridge block. No string adjustment is possible on the bridge, thus easing the restringing process. The musician sets the desired tuning by means of the guitar tuning pegs to which the string first ends are attached. He adjusts the locations of the intonation blocks, and also adjusts the fine tuners. The long spans between the intonation blocks and the string anchor points provides a wide range of adjustability to the strings using the fine tuners. At any time while playing, he can push on the tremolo arm to overcome the force of the spring mechanism and pivot the bridge in the first direction. That action causes the strings to lose tension and therefore change their pitch. When the musician releases the arm, the spring mechanism pivots the bridge in the second direction back to its initial position against the base plate. At that point, the original tension and pitch return to the strings.

The method and apparatus of the invention, using a stud that passes through the base plate and a spring that coacts with the stud and the base plate, thus renders the tremolo self-contained and of compact size. The fine tuners always remain in contact with the strings, even though the thumbscrews are capable of a wide range of axial movement when adjusting the string tensions.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figures 1, 8:
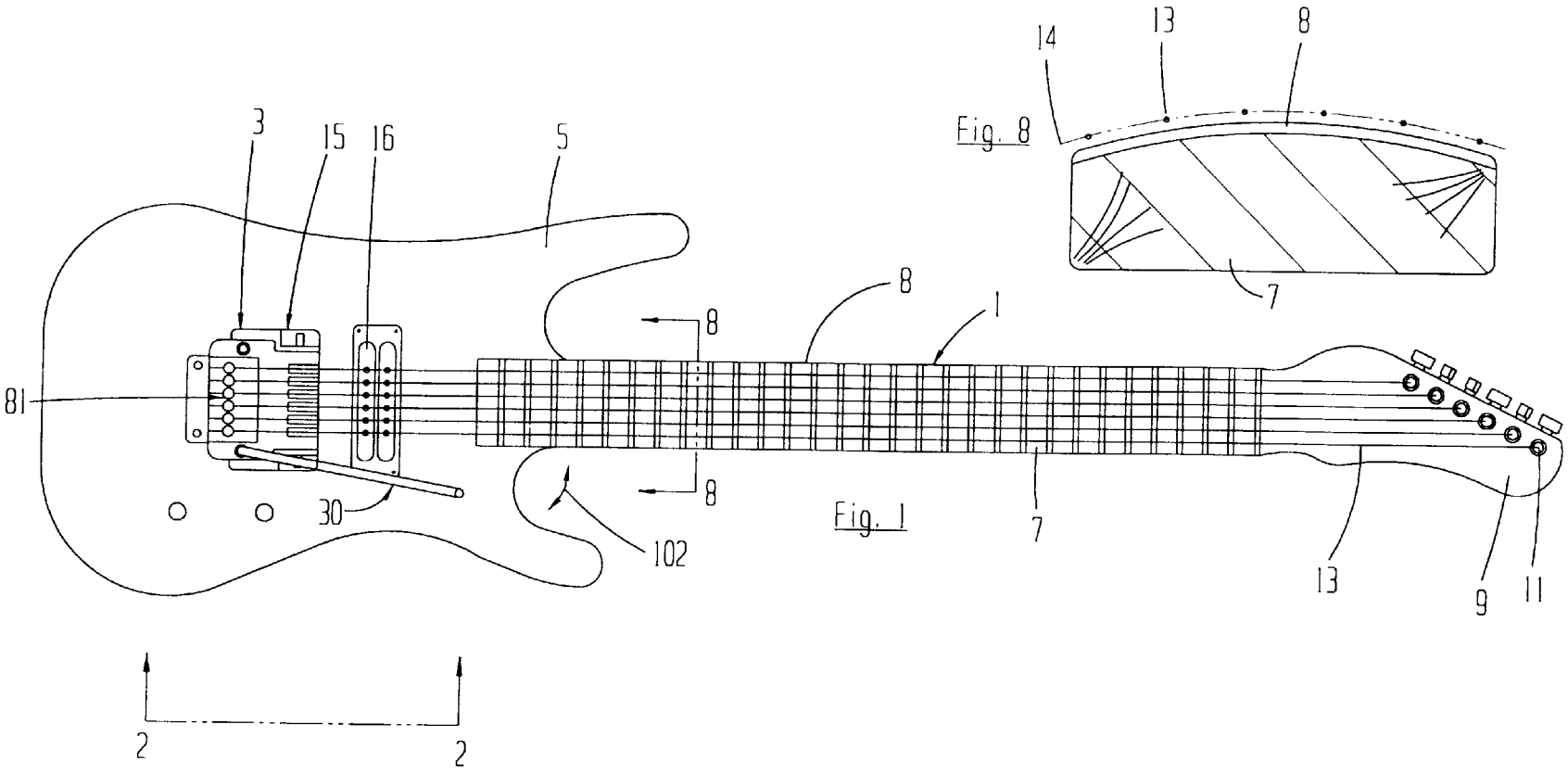
FIG. 1 is a front view of the tremolo of the invention installed on a typical electric guitar.
FIG. 8 is a cross-sectional view on an enlarged scale taken along line 8—8 of FIG. 1 and rotated 90 degrees clockwise.
Figure 3:
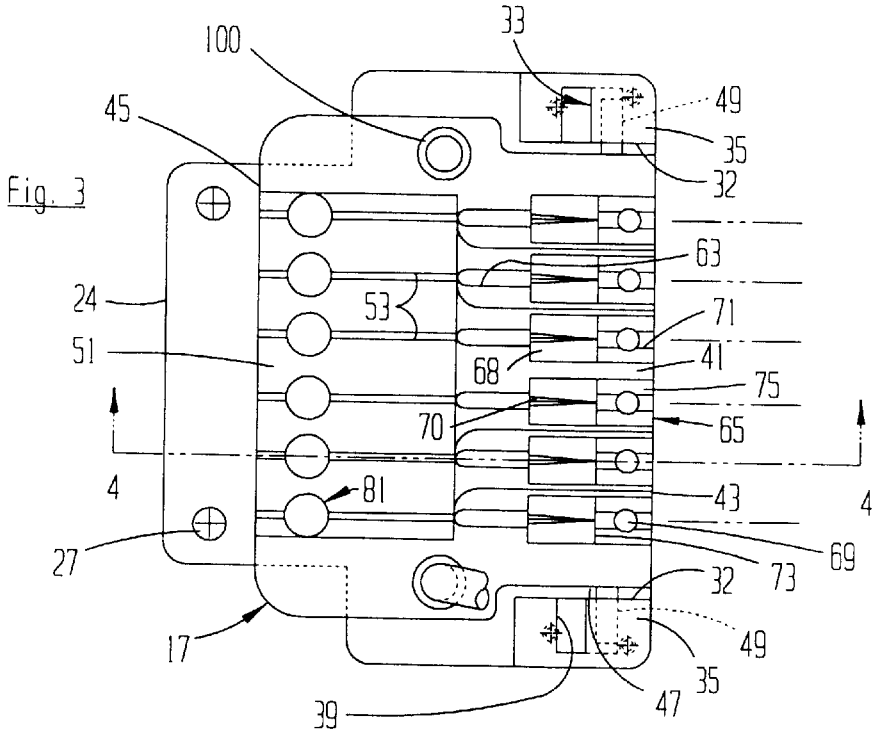
FIG. 3 is a top view of FIG. 2.
Figure 2:
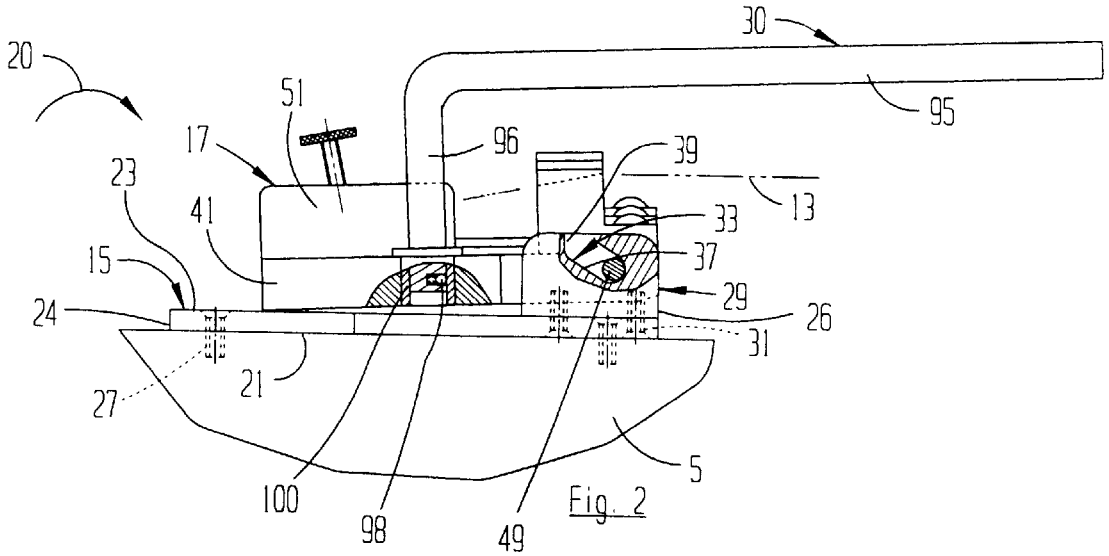
FIG. 2 is a partially broken view on an enlarged scale taken along line 2—2 of FIG. 1.
Figure 6:
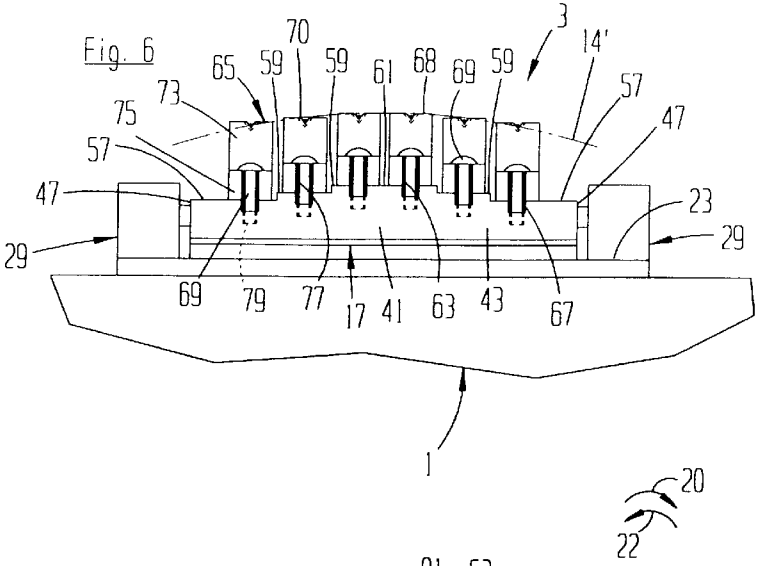
FIG. 6 is a view taken along line 6—6 of FIG. 4.

Referring first to FIGS. 1 and 8, a typical electric guitar 1 is illustrated that includes the tremolo 3 of the present invention. The particular configuration and construction of the guitar 1 shown is merely representative of a wide variety of guitars and other stringed musical instruments that can advantageously use the tremolo 3. Accordingly, it will be understood that the tremolo of the invention is not limited to use with any particular type of string instrument.

General

The guitar 1 is composed of a body 5 and a neck 7 with frets 8. A headstock 9 on the end of the neck 7 opposite the body 5 has a number of adjustable tuning pegs 11. First ends of longitudinally extending strings 13 are attached to associated pegs 11. Second ends of the strings 13 are anchored to the tremolo 3, as will be described shortly. Reference numeral 16 indicates electronic pickups that sense the vibrations of the strings. The neck 7 and frets 8 have a convex shape. As a result, the strings 13 lie in a curved transverse plane 14.

In accordance with the present invention, the tremolo 3 is designed and constructed to be both compact and easy to use. For that purpose, and also referring to FIGS. 2–7, the tremolo is comprised of a base plate 15, a bridge 17, and a spring mechanism 19. Tension in the strings 13 tend to pivot the bridge 17 relative to the base plate 15 in a first direction as indicated by arrow 20. The spring mechanism 19 exerts a stronger force on the bridge to pivot it in a second direction 22. The force of the spring mechanism can be overcome, and the bridge can be pivoted in the direction of arrow 20, by pushing on an arm 30 that is secured to the bridge.

Base Plate

The base plate 15 has a bottom surface 21, a top surface 23, a back edge 24, and a front edge 26. The base plate is fastened to the top surface 29 of the guitar body 5 by several screws 27, only two of which are shown. One or more holes 28 extend through the base plate between the top and bottom surfaces 23 and 21, respectively. As illustrated, there are three holes 28, but more or fewer can be used if desired.

A pair of spaced apart lugs 29 are supported on the base plate top surface 23 at the opposite sides of the base plate front edge 26. The lugs 29 are held to the base plate by screws 31. Each lug has an inside surface 32 and a top surface 35.

It is an important feature of the invention that there is a blind slot 33 in the inside surface 32 of each lug 29. Each slot 33 angles upwardly toward the base plate back edge 24 and opens into the lug top surface 35. The slot may be straight. However, as illustrated, it is preferred that the slot have a sharp bend such that it has a generally L-shape. In that situation, the slot has a long blind leg 37 that terminates within the lug, and a shorter leg 39 at generally right angles to the long leg. The short leg 39 opens into the lug top surface.

Bridge

The bridge 17 is made with a plate section 41 having a front end 43, a back end 45, and indented side edges 47. Protruding from the plate section side edges 47 are a pair of oppositely extending pins 49. The pins 49 are received in associated slots 33 on the lugs 29. In that manner, the bridge is capable of pivoting relative to the lugs, the guitar body 5, and the base plate 15.

There is a block 51 on the bridge plate section 41 near the bridge back end 45. The block 51 defines a number of longitudinal slits 53. At the end of each slit 53 in line with the plate section back end is a depression 55. There is a slit and depression 55 for each guitar string 13. A small ball, not shown, on the end of each guitar string is placed in a corresponding depression 55 and laid in the associated slit. In that manner, the depressions 55 serve as fixed anchor points for the second ends of the strings.

The bridge plate section 41 between the indented side edges 47 and near the bridge front end 43 is not flat. Rather, that portion of the bridge plate section is formed with a series of steps. For a six-string guitar, there are three steps above and between base steps 57, which are on the bridge plate section adjacent the indented side edges. Middle steps 59 lie between the base steps 57 and a highest center step 61. The steps 57, 59, and 61 are longitudinally aligned with and are symmetrical about corresponding slits 53 in the block 51. The steps are thus also symmetrical about the guitar strings 13.

The bridge 17 further defines a number of longitudinal grooves 63 in the plate section steps 57, 59, and 61. The grooves 63 extend to the plate section front end 43. The grooves are symmetrical about the bridge slits 53 and the corresponding strings 13.

The tremolo 3 also includes intonation blocks 65 held on the bridge 17 and in operative association with the guitar strings 13. The intonation blocks 65 are all identical. They rest on the base steps 57 and on the steps 59 and 61. Tongues 67 in the intonation blocks are received and are slidable within the bridge grooves 63.

Figure 4:
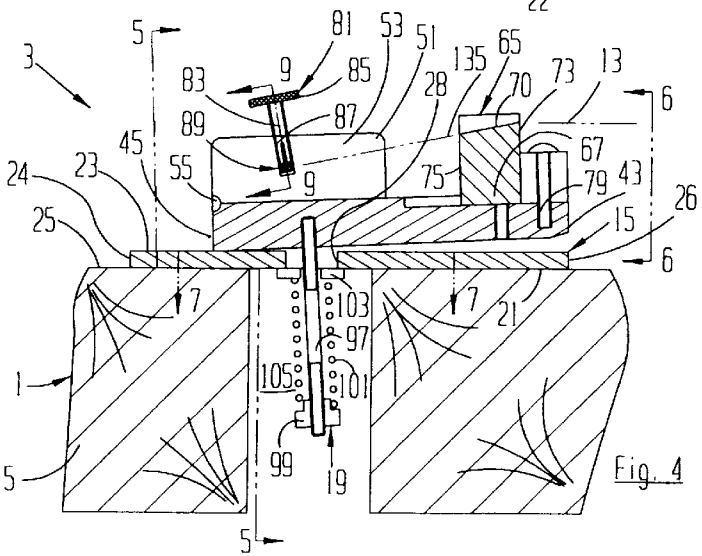
FIG. 4 is a cross-sectional view taken along line 4—4 of FIG. 3.
Figure 7:
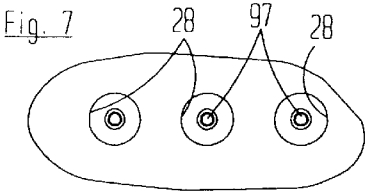
FIG. 7 is a partial view taken along line 7—7 of FIG. 4.

In the top surface 68 of each intonation block 65 is a V-groove 70. The V-grooves 70 slope downwardly from a front side 73 of the intonation block toward a back side 75. Each string 13 of the guitar 1 is in contact with and lies within the V-groove of a respective intonation block. As best shown in FIG. 4, the strings slope downwardly from the intonation block V-grooves to the depressions 55 in the bridge block 51 at an angle of approximately ten degrees to the horizontal.

Each intonation block 65 has a ledge 75 adjacent the front side 73. There is a vertical slot 77 in each ledge 75. A small screw 69 passes through the slot 77 and is threaded into one or the other of tapped holes 79 in the bridge 17. The screws 69 thus hold the intonation blocks to the bridge plate section 41. By sliding the intonation blocks within the grooves 63, the positions of the intonation blocks relative to the bridge and to the guitar strings 13 can be changed. The distances from the contact points between the intonation blocks and the strings to the tuning pegs 11 are the effective playing lengths of the strings. By changing the intonation block positions on the bridge, and maintaining those positions with the screws 69, the effective lengths of the strings, and thus their tonal qualities, can be readily adjusted. It will be noticed that there is a considerable span, designated by reference numeral 13S in FIG. 4, of the strings 13 between the contact points with the intonation blocks and the string anchor points in the bridge depressions 55.

As mentioned, the bridge plate section 41 has three levels of steps 57, 59, and 61. Accordingly, the intonation blocks 65 and their respective V-grooves 70 also lie on three different levels. The heights of the steps 57, 59, 61 are set to correspond with the transverse curved plane 14 of the frets 8 and strings 13, FIG. 8. Consequently, the contact points between the strings and the intonation blocks lie along a curved line 14' that is coplanar with the plane 14, FIG. 6.

Figure 9:
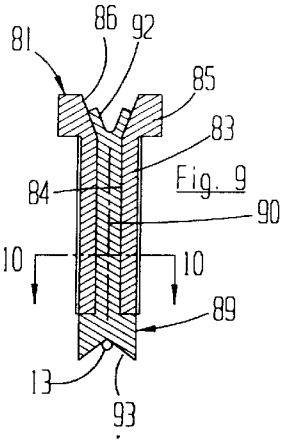
FIG. 9 is a cross-sectional view on an enlarged scale taken along line 9—9 of FIG. 4.
Figure 10:
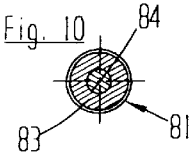
FIG. 10 is a cross-sectional view taken along line 10—10 of FIG. 9.
Figure 5:
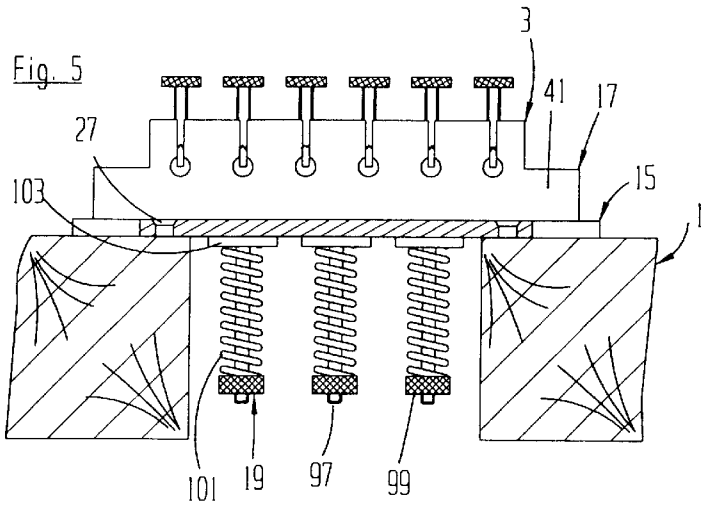
FIG. 5 is a cross-sectional view taken along line 5—5 of FIG. 4.

Further in accordance with the present invention, the tonal qualities of the strings 13 are also adjustable by a fine tuner 81 associated with each string. With reference also to FIGS. 9 and 10, each fine tuner 81 is comprised of a thumbscrew having a threaded shank 83 with a longitudinal hole 84 through it. There is a knurled knob 85 on one end of the shank 83. The hole 84 diverges into a conical shape 86 inside the knob 85.

On the second end of each fine tuner shank 83 is a cylindrical plug 89. The plug 89 includes a long stem 90 that is rotatably received in the shank hole 84. The end of the stem 90 opposite the plug 89 is peened over at reference numeral 92 against the shank conical surface 86. In that manner, the plug is captured in the shank, but the plug is rotatable relative to the shank. On the exposed face of the plug 89 is a V-groove 93.

The thumbscrew shanks 83 are threaded into tapped holes 87 in the bridge block 51. The holes 87 are centered on the slits 53. Preferably, the holes 87 make an angle of approximately ten degrees with the vertical. The plug V-grooves 93 contact the guitar strings 13. By turning the thumbscrews, the tension in the strings can be increased or decreased with attendant changes in the tonal characteristics in the strings. The V-grooves assure that the strings do not slip off the ends of the fine tuners. The rotatable stems 90 inside the shanks enable the thumbscrews to be turned without also tending to twist the strings.

The bridge 17 further includes the arm 30. In the illustrated construction, and again with particular reference to FIG. 2, the arm is L-shaped, having a long leg 95 that generally overlies the guitar body 5. A short leg 96 on the arm has a spring loaded detent 98. The short leg 96 may be inserted into either of a pair of holes in the bridge plate section 41. Friction between the detent 98 and the bridge holes provide resistance to rotating the short leg in the bridge. At the same time, however, the short leg can be intentionally rotated in the bridge in the directions of arrows 102 (FIG. 1). The result is that the musician can readily rotate the arm to the angular location he wants, and the arm will remain at that location by friction until it is again intentionally rotated to a different location. Having two holes in the bridge enables both right handed and left handed musicians to use the tremolo 3 without requiring any alterations to it.

In the preferred embodiment, there is a bushing 100 used with the arm 30. The bushing 100 is pressed in a bridge hole. The bushing is made of a hard steel that withstands the wear associated with inserting, rotating, and removing the arm with the detent 98.

Spring Mechanism

To counteract the tendency of the bridge 17 to pivot in the direction of arrow 20 under the tension of the strings 13, the spring mechanism 19 biases the bridge to pivot in the opposite direction 22. The spring mechanism comprises one or more long studs 97 that are threaded into or otherwise joined to the underside of the bridge plate section 41. The particular spring mechanism shown has three studs 97, but it will be appreciated that more or fewer can be used depending on the particular application of the tremolo 3 to the guitar 1. The studs pass through the holes 28 in the base plate 15 and enter into a cavity 105 in the guitar body 5. It is thus seen that the studs lie in a plane that is generally perpendicular to the plane 14 of the strings.

On the end of each stud 97 is a nut 99. A compression spring 101 is interposed between the nut 99 and a large washer 103 placed against the base plate bottom surface 21. By turning the nuts 99, the forces in the springs 101 are adjustable. The spring force is adjusted to be greater than the tension force in the strings 13. Accordingly, the tremolo 3 is normally in an initial position as shown in the drawings, in which the bridge back end 45 is positively located against the base plate top surface 23.

To preserve the sound qualities of the guitar 1, it is highly desirable that minimum alterations be made to it in order to accommodate the tremolo 3. In the practice of our invention, only the small cavity 105 is required in the guitar body 5. The cavity 105 is just large enough to receive the spring mechanism 19 and to provide finger access to the nuts 99 for adjusting them. In particular, the cavity does not extend behind the electronic pickups 16 (FIG. 1). As a result, any effects on the playing qualities of the guitar due to the tremolo are minimal.

The spring mechanism 19 possesses the further advantage that it renders the tremolo 3 self-contained. That is, the tremolo does not depend on any part of the guitar 1 in order to function. That is because the springs 101 coact only with other parts of the tremolo and not with the guitar itself. Only the base plate screws 27 fasten the tremolo to the guitar. As an important related advantage, that design makes the tremolo very easy to install onto and remove from the guitar.

Installation and Operation

To install the tremolo 3, it is necessary only to fasten the base plate 15 to the guitar body 5 with the screws 27. The slots 33 in the lugs 29 make it very easy to pivotally connect the bridge 17 to the base plate. Further, the bridge pins 49 conveniently remain in the slots while stringing, tuning, and playing the guitar. The fixed depressions 55 in the bridge block 51 make it very easy to install the guitar strings 13. Only relatively course tuning is required from the tuning pegs 11. Fine tuning is easily accomplished by the fine tuners 81. Other tonal qualities are setable by the intonation blocks 65.

The tremolo 3 normally has a fixed position relative to the guitar 1 because of the contact of the bridge 17 with the base plate 15 as caused by the spring mechanism 19. Consequently, the guitar will stay in tune under all operating conditions despite the presence of the tremolo. For example, if one string 13 should break, the tensions in the other strings are not affected. On the other hand, intentionally pushing on the arm 30 simultaneously loosens the tensions in all the strings to cause a variation in the sounds produced by the guitar. When the arm is released, the spring mechanism 19 returns the tremolo to the initial position such that the guitar can again be played in the normal fashion.

A particularly important aspect of the invention is the long span 13S of the strings 13 between the depressions 55 and the intonation blocks 65. Specifically, there is no support or contact of the strings by any part of the tremolo 3 along the span 13S except for the fine tuners 81. The fine tuners are thus able to introduce a wide range of tuning to the strings. For example, in one embodiment of the tremolo as used on a particular guitar, the fine tuners are able to change the string pitch as much as seven frets 8 on the guitar neck 7.

After the guitar 1 is tuned to suit the musician, he plays it in the normal manner. When he wants to dive the strings 13, he merely presses the arm 30 to overcome the force of the spring mechanism 19 and pivot the bridge 17 in the direction of arrow 20. The detent 98 enables him to easily rotate the arm to his liking, and the arm will remain in the desired location until again changed.

In summary, the results of guitars and other stringed musical instruments can now be more fully realized. The tremolo 3 provides both the ability to alter the sounds produced by the strings 13 as well as ease of installation and operation. This desirable result comes from using the combined functions of the spring mechanism 19. The spring mechanism coacts between the base plate 15 and the bridge 17 in a manner that renders the tremolo self-contained. The spring mechanism is further designed to occupy minimal space within the guitar body 5. As a result, alterations to the guitar body to accommodate the tremolo are minimal. The fixed anchor points for the strings in the bridge depressions 55 further aid in ease of assembly and tuning. The long spans 13S of the strings between the bridge depressions and the intonation blocks 65 provide a much greater range of fine tuning adjustment than is possible on prior tremolos. The rotatable plugs 89 with their V-grooves 93 enable fine tuning in the spans 13S without twisting the strings or having them slip off the ends of the fine tuners 81. The detent 98 in the arm 30 enables the arm to be rotated to any angular location relative to the guitar body 5 without adjusting or manipulating any other component. The slots 33 and the lugs 29 provide a positive connection for the bridge 17 on the base plate 15, thereby further contributing to the ease of assembly and operation.

It will also be recognized that in addition to the superior performance of the tremolo 3, its construction is such as to cost little, if any, more than traditional tremolos. Also, because it is made of a simple design and of rugged components, it gives long service life with minimal maintenance.

Thus, it is apparent that there has been provided, in accordance with the invention, a tremolo for guitar that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A tremolo for a musical instrument having a plurality of longitudinally extending strings that lie in a selected plane and that have respective first ends secured to the instrument and respective second ends comprising:

a. a base plate lying in a flat plane and defining at least one hole therethrough;

b. means for immovably fastening the base plate to the instrument;

c. a bridge connected to the base plate for pivoting in first and second directions relative to the base plate, the second ends of the strings being anchored to the bridge with selected tensions in the strings that tend to pivot the bridge in the first direction;

d. a plurality of substantially identical intonation blocks each adjustably held to the bridge and in contact with the strings at respective contact points;

e. at least one stud joined to the bridge and passing through the hole in the base plate;

f. means for cooperating with said at least one stud to bias the bridge to pivot in the second direction with a force greater than the selected tensions in the strings until the bridge contacts the base plate; and g. means for manually pivoting the bridge in the first direction and thereby decrease the tensions in the strings, so that the tremolo is self-contained and requires no fastening between the tremolo and the instrument other than the means for fastening the base plate to the instrument.

2. The tremolo of claim 1 wherein:

a. the bridge comprises a pair of oppositely extending pins; and b. a pair of lugs are supported on the base plate, each lug defining a blind slot, the slots receiving respective pins on the bridge and cooperating therewith to pivotally connect the bridge to the base plate.

3. The tremolo of claim 2 wherein the lug slots are at an angle to the plane of the base plate.

4. The tremolo of claim 2 wherein the lug slots are generally L-shaped.

5. The tremolo of claim 1 wherein:

a. the bridge is formed with a plate section and a block integral with and upstanding from the plate section, the block having a number of depressions equal to the number of instrument strings and in which the second ends of the respective strings are fixedly anchored, there being a plurality of longitudinal slits in the block aligned with respective depressions through which the respective strings pass without contacting the block; and b. the tremolo further comprises a fine tuner within each slit in the bridge block and in operative association with the string in the associated slit.

6. The tremolo of claim 5 wherein the fine tuner comprises:

a. a shank that adjustably engages the bridge block and defines first and second ends, the shank having a hole therein;

b. a knob on the shank first end; and c. a plug at the shank second end, the plug having a V-groove that engages the string in the associated slit and a stem that is rotatably received in the hole in the shank, so that the shank can be adjusted relative to the block and thereby change the tension in the associated string.

7. The tremolo of claim 6 wherein the shank is threaded and engages a threaded hole in the bridge block to enable the shank and plug to move linearly along the block hole in response to turning the shank without turning the plug within the shank, so that the string does not twist within the slit or fall off the end of the fine tuner when the fine tuner is adjusted.

8. The tremolo of claim 6 wherein:

a. the hole in the shank defines a frusto-conical surface proximate the shank first end that diverges toward the shank first end; and b. the plug stem has a frusto-conical surface that contacts the shank frusto-conical surface, so that the plug is captured in the shank but is rotatable relative to the shank.

9. The tremolo of claim 5 wherein:

a. the bridge plate section defines a plurality of steps, the steps including a highest center step, base steps, and middle steps between the base steps and the center step; and b. the intonation blocks are held on respective steps, so that the contact points of the intonation blocks with the respective strings define a curved line.

10. The tremolo of claim 1 wherein the means for cooperating with said at least one stud comprises:

a. a nut on said at least one stud; and b. a compression spring interposed between the base plate and the nut, the spring coacting with the nut, stud, and base plate to bias the bridge to rotate in the second direction.

11. The tremolo of claim 10 wherein the nut is adjustable on the stud to thereby adjust the amount of the bias of the bridge to rotate in the second direction.

12. The tremolo of claim 10 wherein said at least one stud and the means for cooperating with said at least one stud occupy a cavity within the instrument.

13. The tremolo of claim 1 wherein the means for manually pivoting the bridge comprises:

a. a generally L-shaped arm having a first leg received in the bridge; and b. means for producing a friction force between the arm first leg and the bridge that enables a person to initially rotate the arm in the bridge to a selected angular location and that retains the arm in the selected location until the person rotates the arm to a different location.

14. The tremolo of claim 1 wherein the means for manually pivoting the bridge comprises:

a. a pair of bushings in the bridge;

b. a generally L-shaped arm having a first leg received in a selected one of the bushings; and c. means for producing a friction force between the arm first leg and the selected bushing.

15. The tremolo of claim 14 wherein the means for producing a friction force is a spring loaded detent in the arm first leg.

16. The tremolo of claim 1 wherein said at least one stud is generally perpendicular to the plane of the instrument strings.

17. Self-contained apparatus for diving the strings of a guitar having a cavity therein comprising:

a. a base plate fastened to the guitar over the cavity;

b. a bridge having a front end pivotally connected to the guitar and a back end, the strings being fixedly anchored to the bridge and adjustably fastened to the guitar with selected tensions that tend to pivot the bridge in a first direction;

c. means for biasing the bridge to pivot the back end thereof in a second direction and into contact with the base plate;

d. means for fine tuning the strings; and e. means for assisting a person to pivot the bridge in the first direction and thereby decrease the tension in the strings.

18. The apparatus of claim 17 wherein:

a. the base plate defines at least one hole therethrough; and b. the means for biasing the bridge comprises:

i. at least one stud received in the bridge and passing through the base plate hole and entering the guitar cavity;

ii. a spring on said at least one stud; and iii. means on said at least one stud for cooperating with the spring, stud, and base plate to produce a force on the bridge that biases the bridge to pivot in the second direction.

19. The apparatus of claim 17 wherein:

a. the base plate supports a pair of lugs each defining a blind slot; and b. the bridge comprises a pair of pins proximate the bridge front end that are received in respective lug slots to thereby pivotally connect the bridge to the base plate.

20. The apparatus of claim 19 wherein:

a. each lug has a top surface; and b. the slot in each lug opens into the lug top surface.

21. The apparatus of claim 20 wherein the slot in each lug is generally L-shaped having a blind long leg and a short leg that opens into the lug top surface.

22. The apparatus of claim 17 wherein:

a. the bridge comprises a plate section and a block upstanding from the plate section, the block having a slit and a depression associated with each guitar string, the depressions fixedly anchoring second ends of guitar strings and the strings passing through the associated slits; and b. the means for fine tuning comprises a fine tuner associated with each slit and in adjustable contact with the associated string.

23. The apparatus of claim 22 wherein the fine tuner comprises:

a. a shank in threaded engagement with the block and having a hole therethrough; and b. a plug having a stem that is rotatably received in the shank hole, the plug being within the associated block slit and having a V-groove that is in contact with the string in the block slit, so that rotating the shank causes it to move linearly within the slit to adjust the string tension without twisting the string.

24. The apparatus of claim 23 wherein:

a. the shank hole defines a first frusto-conical surface; and b. the stem is formed with a second frusto-conical surface that cooperates with the first frusto-conical surface to capture the plug in the shank.

25. The apparatus of claim 17 wherein the means for assisting a person to pivot the bridge comprises an arm having a leg with a spring-loaded detent therein, the detent being inserted into the bridge for retaining the arm by friction in the bridge, the arm being rotatable to a first selected angular location within the bridge and maintaining the selected location until the person intentionally rotates the arm to a second selected location.

26. The apparatus of claim 17 wherein the means for assisting a person to pivot the bridge comprises:

a. a pair of bushings in the bridge;

b. an arm having a first leg received in a selected one of the bushings and a second leg; and c. a spring-loaded detent in the first leg that cooperates with the selected bushing to enable a person to manually rotate the arm to a selected angular location on the guitar and that maintains the arm at the selected location by friction between the bushing and the detent.

27. The apparatus of claim 22 further comprising a plurality of intonation blocks held on the bridge and having contact points with the respective strings, the intonation blocks cooperating with the bridge block depressions to form long spans between the depressions and the associated intonation block contact points, so that the means for fine tuning is able to produce a wide range of fine tuning on the strings.

28. The apparatus of claim 27 wherein the bridge is formed with a plurality of steps of selected heights under the intonation blocks, so that the contact points of the intonation blocks with the respective strings lie along a selected curved line.

29. A method of tuning and playing a guitar comprising the steps of:

a. fastening a base plate having at least one hole therethrough to the guitar;

b. pivotally connecting a bridge to the base plate;

c. fixedly anchoring second ends of guitar strings to the bridge at respective anchor points, and adjustably attaching first ends of the strings to the guitar with respective tensions that tend to pivot the bridge in a first direction;

d. inserting at least one stud through the base plate hole and into the bridge;

e. placing a spring over said at least one stud and into contact with the base plate;

f. tightening a nut against the spring and causing the spring to act between the base plate and the stud and nut and thereby biasing the bridge to rotate in a second direction until the bridge contacts the base plate; and g. manually pivoting the bridge in the first direction and thereby loosening the tension in the strings.

30. The method of claim 29 wherein the step of pivotally connecting a bridge to the base plate comprises the steps of:

a. providing the base plate with a pair of blind slots;

b. providing the bridge with a pair of pins; and c. inserting the bridge pins into the base plate slots.

31. The method of claim 30 wherein the step of providing the base plate with a pair of blind slots comprises the step of providing the base plate with a pair of blind L-shaped slots.

32. The method of claim 29 comprising the further steps of:

a. holding a plurality of intonation blocks on the bridge each in contact with a guitar string at a respective contact point and thereby creating spans of the strings between the intonation blocks and the associated string anchor points;

b. providing the bridge with fine tuners in contact with the spans of the respective strings; and c. simultaneously rotating and linearly moving the fine tuners within the bridge and thereby changing the tension in the strings without twisting the strings or losing contact between the strings and the respective fine tuners.

33. The method of claim 32 wherein:

a. the step of providing the bridge with fine tuners comprises the steps of:

i. threading a plurality of shanks with respective holes therethrough into the bridge; and ii. capturing a plug in each shank hole, and contacting the plugs with associated strings; and b. the step of simultaneously rotating and linearly moving the fine tuners comprises the steps of rotating and linearly moving the shanks and simultaneously linearly moving the associated plugs without rotating the plugs relative to the strings.

34. The method of claim 33 wherein the step of capturing a plug in each shank hole comprises the step of capturing a plug having a V-groove in contact with the associated string.

35. The method of claim 32 wherein:

a. the step of pivotally connecting a bridge comprises the step of providing a bridge with a number of selected steps thereon; and b. the step of holding a plurality of intonation blocks on the bridge comprises the steps of:

i. holding a plurality of identical intonation blocks on the bridge steps; and ii. selecting the bridge steps such that the contact points of the intonation blocks with the respective strings lie along a selected curved line.

36. The method of claim 29 wherein the step of manually pivoting the bridge in the first direction comprises the steps of:

a. providing an arm with a short leg and a long leg;

b. providing a spring-loaded detent in the arm short leg; and c. inserting the arm short leg into the bridge for a friction fit between the detent and the bridge.

37. The method of claim 36 wherein the step of inserting the arm short leg into the bridge comprises the steps of:

a. manually rotating the arm within the bridge to a selected angular location relative to the guitar; and b. maintaining the arm at the selected location by friction between the detent and the bridge.

* * * * *